US005253721A

United States Patent [19]

Lee

[11] Patent Number: 5,253,721

[45] Date of Patent: Oct. 19, 1993

[54] DIRECTIONAL BORING HEAD

[75] Inventor: Douglas W. Lee, Wichita, Kans.

[73] Assignee: Straightline Manufacturing, Inc., Newton, Kans.

[21] Appl. No.: 880,589

[22] Filed: May 8, 1992

[51] Int. Cl.[5] ..... E21B 7/08

[52] U.S. Cl. ..... 175/73

[58] Field of Search ..... 175/73–76, 175/65, 19

[56] References Cited

U.S. PATENT DOCUMENTS 3,794,128 2/1974 Gagen et al. ..... 175/73

5,131,479 7/1992 Boulet et al. ..... 175/73

5,148,880 9/1992 Lee et al. ..... 175/73 X

*Primary Examiner*—Thuy M. Bui

*Attorney, Agent, or Firm*—Edward L. Brown, Jr.

[57] ABSTRACT

A steerable drill head which utilizes the combination of a hydraulic cutting nozzle and a rotary mechanical cutting blade wherein the drill string is intermittently rotated and lineally advanced in the bore. The drill head further includes a ramp attached to the head behind the cutting blade including a steering surface for deflecting the drill head and its string in a particular direction by linear advancement without rotation. The cutting blade is positioned at the center of the head with the plane of the blade positioned on the axis of rotation of the drill head.

9 Claims, 3 Drawing Sheets

DIRECTIONAL BORING HEAD

BACKGROUND OF THE INVENTION

This invention relates to horizontal directional boring machines and more specifically to a drilling head construction which utilizes a rotating cutting blade for drilling a bore hole in conjunction with a fluid cutting jet and an inclined steering surface to steer the drill string and head in a specific direction.

Guided horizontal boring machines is a new field of technology which is replacing conventional trenching machines for the placement of utility lines, such as electricity, telephone, water and gas. The conventional manner to install or replace these utility lines was with conventional trench digging equipment where a ditch is first dug in the area where the line is desired. The utility line is then installed and the ditch is covered. While the trenching machines of today are making more narrow trenches to minimize the work and settling, the advantages of eliminating trenching completely far surpass the various problems which exist with directional horizontal boring. As for example, horizontal boring permits utility lines to be run under existing streets, highways, and landscaped yards without disturbing the surface with any type of trench or the traffic on the street. Digging a trench also creates a greatly increased chance of disturbing existing utility lines and lastly the time and labor involved is substantially reduced. Guided horizontal boring machines, also referred to as trenchless construction techniques, have become very viable and cost effective. These new guided machines can bore along a straight or veering path at any desired depth and reach an end point within two feet of its desired location. Replacement and retrofit construction of underground utility services in urban and suburban areas is an immense application for this technology.

Initial efforts of horizontal boring for utility lines were not guided, but rather commenced from a pre-dug hole drilling a horizontal unguided hole to an existing second hole or trench as typified in U.S. Pat. No. 3,451,491. there has long existed horizontal large tunnel boring machines, sometimes referred to as pipe jacking machines. However, these machines and technology are limited to large tunnel boring, while the directional boring machines of the present invention are limited to relatively small pilot boring on the order of less than 5 inches which in turn can be reamed out up to 12 inches.

The steering capability of horizontal boring machines over a variable path is achieved by various types of drilling heads which in turn use both hydraulic forms of cutting as well as mechanical cutting with hardened bits or a combination of both.

Various hole forming methods are utilized depending upon the soil conditions encountered. Some of the early directional boring machines operated down-hole tools from an umbilical supplied power source through hoses and electrical wires. In the early 1960's, AT&T Bell Laboratories developed an umbilical type guided boring device, also referred to as a percussion or impact mole which was powered by pressurized fluids and electrical lines trailing the tool. The mole was steered by an articulated body and movable fins on the mole for rotating the mole into the steering position.

The alternative to an umbilical supplied tool involved a string of flexible drill rod or tubing controlled on the surface by a drill frame which applied thrust for lineal movement and rotational torque for cutting along with pressurized fluids for cutting. The directional boring machines which are currently on the market are all the "drill string" latter type with drill frames on the surface which apply thrust, and rotation for guiding the drill string and hydraulic pressure in the case of hydraulic cutting tools. Some drill frames start their bore from the surface, such as U.S. Pat. No. 4,905,773, while 4,592,432 and U.S. Pat. No. 4,694,913. In the '432 patent, the head is guided by a movable vane on the head which is controlled at the surface. The '913 patent is guided by a fixed slanted face and precise rotation of the head.

There are various hole forming methods utilized in these guided boring machines, the uses of which are dictated by the various soil conditions. The compaction type method of hole forming basically displaces to the side the material in the bore hole and utilizes either rod pushing or a percussive drill head, such as taught in the previously mentioned '913 patent to McDonald, et al. Another method of hole forming in harder soilds is to mechanically cut the hole with a rotating hardened bit, as typified in U.S. Pat. No. 3,746,106. The mechanical cutting bit can either be dry in the case of hard dry soils or soft rock or can be supplied with a fluid stream through the drill pipe and bit with the fluid functioning to liquify and to transport the cuttings away from the drill bit.

In oil field drilling technology, which is basically vertical drilling on a different scale, there has developed a deflecting bit technology in the 1930's and 40's, as typified in U.S. Pat. Nos. 2,196,940 and 2,324,102. These directional bits, also referred to as "spudding" bits, were utilized in an oil well bore when it was desirable to change direction or guide the bore in a different direction. All of these spudding type bits utilized a canted surface on the end of the drill string for deflecting the bit and the drill string laterally during thrusting or lineal movement of the bit. While both of these spudding bit designs could be rotated to cut away the bore hole, they were basically used only for non-rotative thrusting action.

Aside from mechanically cutting the bore hole, another technique, generally referred to as fluid cutting with the use of high velocity fluid jets, are utilized in certain softer soils, as typified in U.S. Pat. No. 4,674,579 to Geller, et al. These high pressure low volume jets hold the cuttings in suspension and form a slurry while the head compacts the slurry into the bore wall for supporting the hole. Some boring machines, such as the present invention, utilize a combination of mechanical cutting along with low volume high pressure fluid cutting. U.S. Pat. No. 4,953,638 to Dunn also typifies a dual cutting operation wherein a flat cutting blade is inclined whereby it acts as a turning surface when it is not rotating.

U.S. Pat. No. 4,679,637 to Cherrington, et al, also teaches a dual cutting head wherein an inclined ramp on the front of the head cuts when rotated and turns the head when rotation stops.

The various methods for steering the drill head include a slanted face, a bent head, an angled fluid jet, a movable vane and various combinations thereof. All of these steering methods create a side force on the drilling head as the head is thrusted forward in the soil. If the head is being rotated during this thrusting action, the lateral forces cancel each other out during a complete rotation of the head and the bore path is substantially straight. However, when it is desired to turn the head in a certain direction, the rotation is stopped with the angled face or angled jet pointing in the direction of the turn and then the drill string is thrusted forward thereby effecting a turn. The location of the down-hole drilling head and the angular position of the steering surface is electronically sensed on the surface from a radio transmitter located within the drilling head. The previously mentioned patent to Geller, et al illustrates typical electronics circuits for determining the angle and location of the head in its down-hole position. The Geller, et al patent is the most widely used and accepted directional boring apparatus used throughout the world with a steering head which is bent and utilizes an angled fluid jet. The steering head is moved to the desired rotational orientation of the angled jet and then advanced into the bore hole without further rotation.

SUMMARY OF THE INVENTION

The boring head of the present invention utilizes both mechanical and fluid cutting, however, the the cutting blade is separate and distinct from the turning surface in the form of a ramp positioned behind the cutting blade. In the previously mentioned patents to Dunn and Cherrington, the turning surface is also the cutting blade. The oil field type spudding bits, previously mentioned in U.S. Pat. Nos. 2,196,940 and 2,324,102 also teach a similar design. The cutting blade of the present invention is positioned on the turning axis of the drill head and provides a more efficient cutting action than a slanted blade thereby requiring less horse power from the drilling frame for each bored foot drilled. The turning surface on the ramp means is located within the blade hole radius and therefore does not drag on the edge of the hole during rotation of the drill head which also produces less drag during drilling. The turning surface on the ramp includes a series of longitudinal flutes which enhance the tracking movement of the head and the effectiveness of the steering surface is maximized with its increased area over smaller steering surfaces of the prior art.

The cutting action of the drill blade takes place as the tool is rotated and advanced into the ground. The plane of the cutting blade is positioned on the axis of rotation of the head and utilizes a symmetric stepped cutting surface on both sides of the blade to bore the hole. The high pressure jets positioned adjacent the blade also assist in the cutting action as the head is advanced and rotated. When it is desirous to turn the drill head, the drill head rotation is stopped when the steering surface is aligned with the direction of the turn. With the rotation stopped, the drill string and head are thrusted forward with the steering surface turning the head to its desired direction whereupon rotation of the drilling head is again commenced.

It is therefore the principal object of the present invention to provide a new and improved drilling head which provides more efficient mechanical and hydraulic cutting while providing a more effective steering surface from that of the prior art.

Another object of the present invention is a drilling head wherein the steering surface in the rotational cutting mode does not contact the wall of the bore hole.

Another object of the present invention is to provide a directional drilling head with the cutting bit being separate and apart from the steering surface.

Another object of the present invention is to provide a directional drilling head when the cutting bit is positioned on the rotational axis of the head for improved efficiency.

DESCRIPTION OF THE PREFERRED EMBODIMENT

Figure 8:
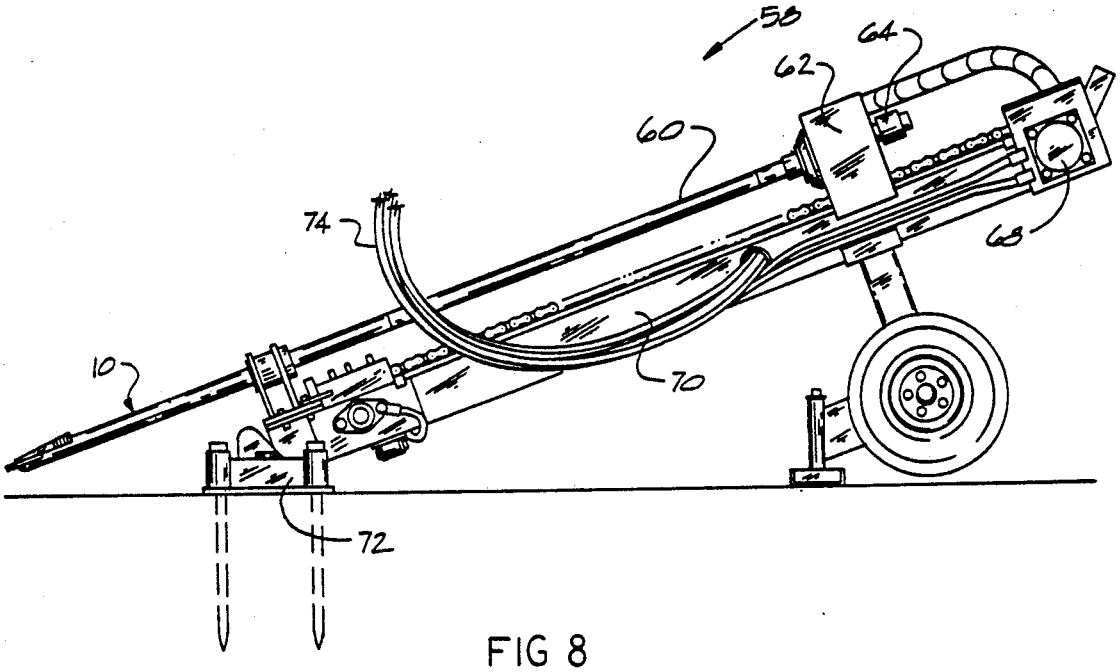
FIG. 8 is a side elevational view of the drilling frame utilized with the present invention.

FIG. 8 is a side view of the drilling frame with which the present invention is used, and is generally identified by numeral 58. The frame 58 includes a drill rack 70 which supports and guides a carriage 62 which in turn attaches to the end of a conventional drill string 60 which has a series of sections joined by conventional tapered threaded joints, none of which is shown in detail. Carriage 62 includes a drive motor 64 which provides rotative torque to the drill string. The lineal thrusting force on the drill string is provided by a chain and hydraulic motor 68 which moves the carriage 62 up and down the drill rack 70. The drill frame 58 is anchored to the ground through an anchor plate 72 which is attached to the ground through a series of stakes. Hydraulic power is provided to the drilling frame 58 through a series of hydraulic lines 74 which provide pressurized fluid for driving motors 64 and 68 and also cutting fluid supplied to the nozzles in the drilling head 10. The pumps and reservoirs which supply hydraulic lines 74 are conventional and are not shown in the drawings.

Figures 1, 2, 6, 7:
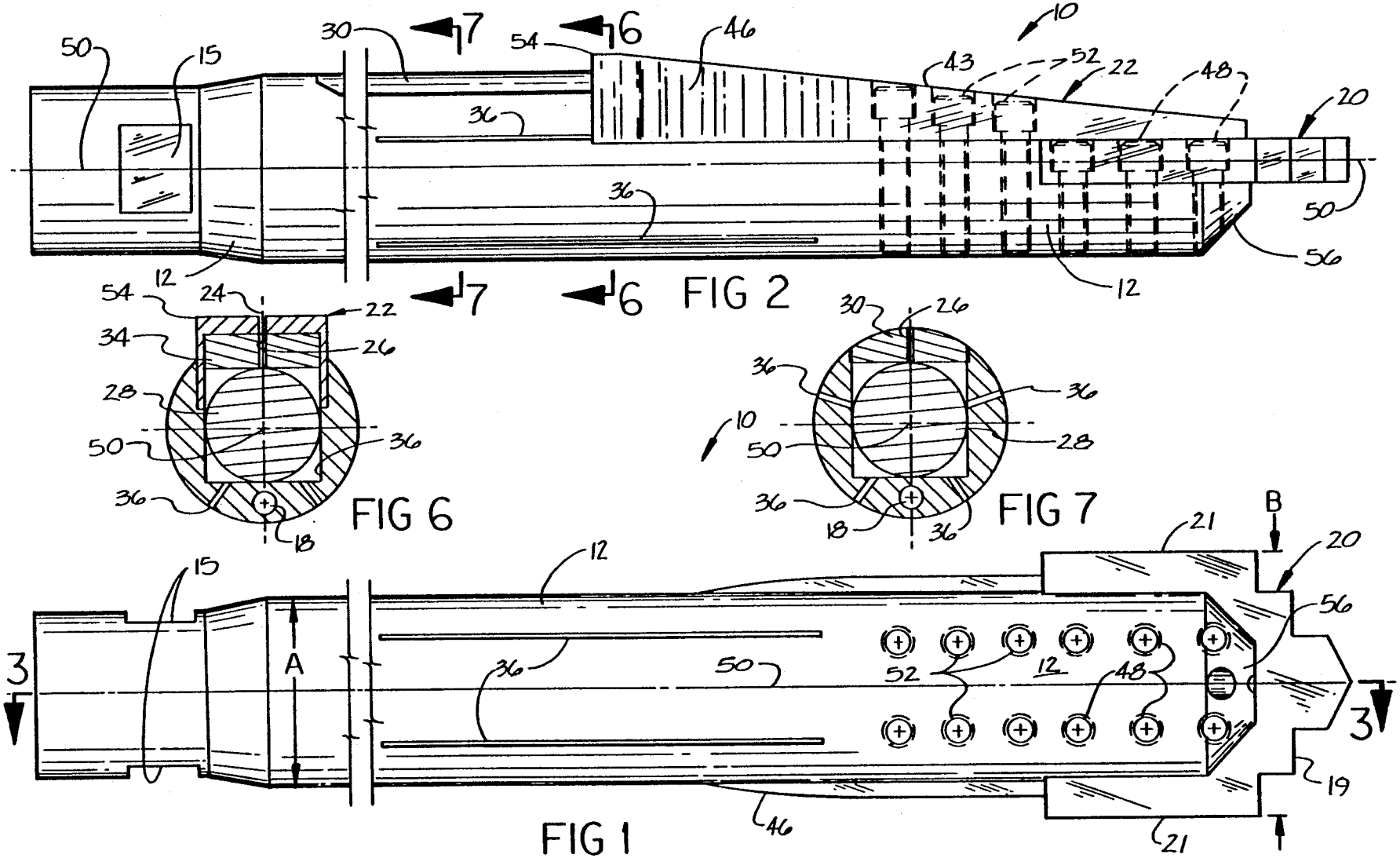
FIG. 1 is a bottom plan view of the drilling head of the present invention with portions in the rear of the head broken away.
FIG. 2 is a side elevational view of the drilling head.
FIG. 6 is a lateral section through the head taken along lines 6—6 of FIG. 2.
FIG. 7 is another lateral section taken along lines 7—7 of FIG. 2.

FIG. 2 is a side elevational view of the drilling head which is the subject matter of the present invention and is generally referred to by reference numeral 10. The drilling head includes a body 12 with an integrally threaded box 14 which couples with a conventional section of hollow drill string 60 which is well-known in the prior art and not shown in detail. Located at the forward end of the drilling head 10 is a cutting blade 20 which is symmetrically centered on the rotational axis 50 of the drill head and connecting string.

Figure 3:
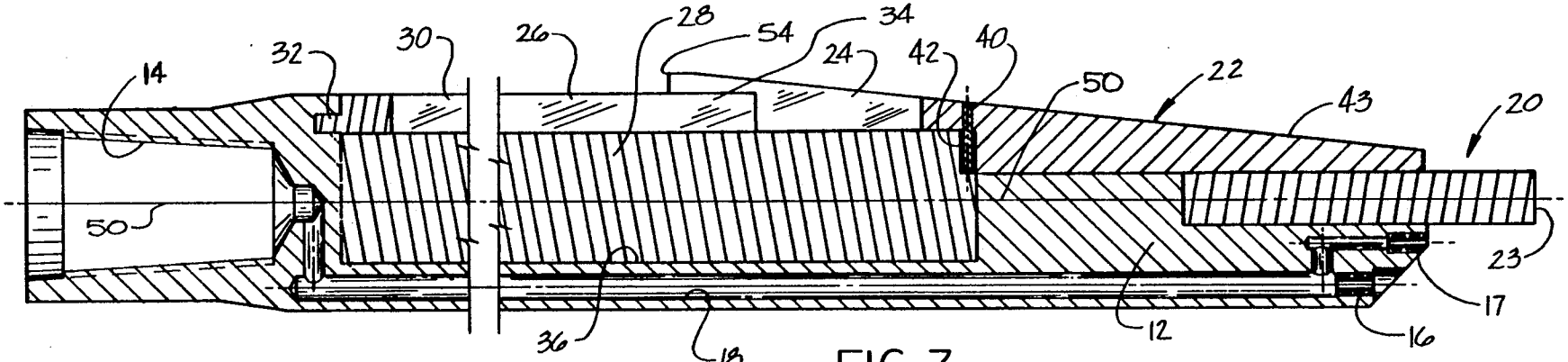
FIG. 3 is a longitudinal section taken along lines 3—3 of FIG. 1.

Also positioned at the forward end of the head 10 are a pair of cutting nozzles 16 and 17, as seen in FIG. 3, which supply high velocity jets of cutting fluid to the end of the bore hole. The pumps which supply this high pressure fluid are well known in the art. Drill passage 18 through the body 12 of the head connects the nozzles 16 and 17 to threaded coupling 14 at the rear of the head. The high pressure cutting fluid is supplied through the hollow sections of the drill string 60 which are connected to threaded box 14.

Figure 4:
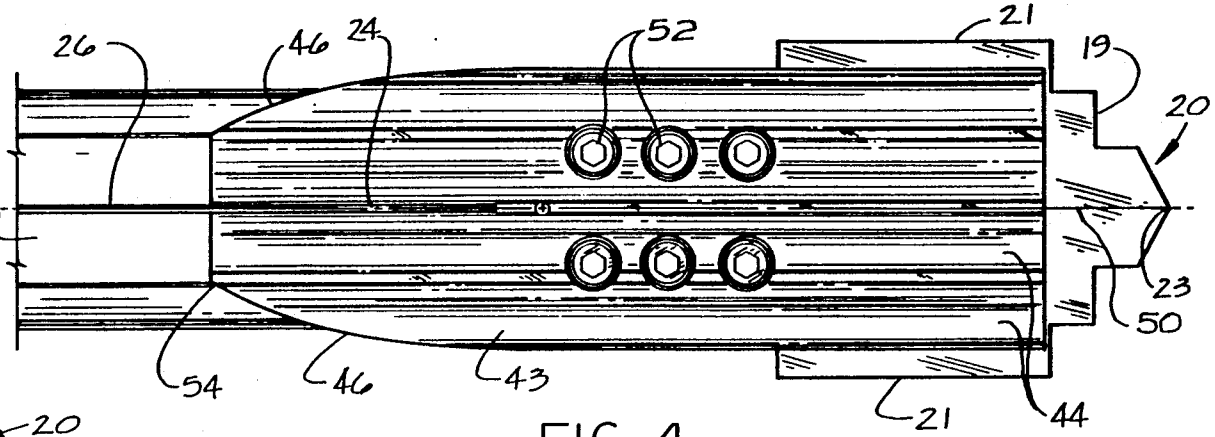
FIG. 4 is a top plan view of the head with the rear portions broken away.
Figure 5:
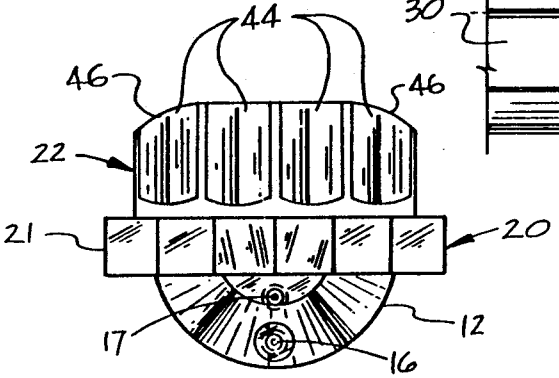
FIG. 5 is a front view of the head.

Located in the center of body 12 is a longitudinal cavity which contains a sonde or radio transmitter 28 which is not shown in detail since they are well-known in the prior art and shown in the previously mentioned patent to Geller, et al. Access to the sonde 28 is provided by a cover plate 30, as best seen in FIGS. 2, 3 and 7. The plate 30 includes a tongue 32 which mates with a similar groove in body 12, as seen in FIG. 3. The right end of cover plate 30 includes a lug 34, as seen in FIGS. 3 and 6. Overlapping cover plate 30 is a ramp member 22 which is releasably attached to the body 12 through six cap screws 52, as seen in FIGS. 2 and 4. Ramp 22 includes a substantially flat steering surface 43 which includes a series of longitudinal flutes 44 which run the full length of the ramp, as best seen in FIGS. 4 and 5. The left end of ramp 22 overlays and surrounds the lug 34, so as to retain the cover plate 30 in place, as best seen in FIG. 6.

Positioned radially around the circumference of drilling head 10 are a series of four radio wave slots 36, as best seen in FIG. 7, which permit the sonde 28 to emit radio waves upwardly regardless of the rotational position of head 10. A fifth radio wave slot 26 is provided in the body 12 which passes through the center of cover plate 30, as best seen in FIGS. 3 and 4. Ramp 22 includes a similar slot 24, as shown in FIG. 3, which is merely an extension of slot 26 in cover plate 30. Cutting blade 20 has a stepped hardened surfaces 19 which extend symmetrically from point 23 on the rotational axis 50 to the outer edges 21 on both sides of the drilling head 10. The rotation of blade 20 cuts a blade hole diameter B, as shown in FIG. 1. Mounted in the stepped cutting surfaces 19 are carbide inserts which are well-known in drilling bits. The cutting edges of blade 20 could be of various other shapes well-known in the bit art including a flat end. Cutting blade 20 is attached to the drilling head body 12 by six cap screws 48, as best seen in FIGS. 1 and 2. Blade 22 is shown as a single blade extending from both sides of the head 10; however, blade 20 could also comprise two mirror image blades separated along the rotational axis 50 of the head. With two separate blades, each blade would be attached to to the head by the same three cap screws 48 located on each side of axis 50, as seen in FIG. 1.

The steering surface 43 of ramp 22 is inclined to the rotational axis of the head at approximately 8°, as best seen in FIG. 2. In plan view ramp 22 is basically rectangular in shape with the sides tapered inward by arcuate surfaces 46, as seen in FIG. 4. As the steering surface 43 moves further away from the rotational axis 50 of the head, its side edges, when rotated, create a larger circle of rotation. The reason for tapering the rear width of the ramp 22 is to insure that those edges 46, when rotated, stay within the blade hole diameter B and do not drag on the wall of the bore hole. This configuration provides a maximum surface area on the steering surface 43 while not staying within the bore hole diameter. The rear corner 54 of ramp 22 has a circle of rotation slightly less than the edges 21 of cutting blade 20.

The forward end of drill head body 12 includes a conical surface 56, as seen in FIGS. 1 and 2, in which nozzles 16 and 17 are located. The body 12 with the exception of its cut-out portions is circular in lateral cross section having a diameter A, as indicated in FIG. 1. The width of the ramp 22, as seen in FIGS. 1 and 4, with the exception of the tapered arcuate surfaces 46, is greater than head diameter A but less than blade hole diameter B.

OPERATION

The directional drilling head 10 of the present invention is advanced into the ground from its FIG. 8 position with the drill string rotating as carriage 62 moves down the drill rack 70 and the head 10 is advanced into the ground. The cutting action achieved is through the combination of rotating blade 20 and the high velocity jets 16 and 17 directed along the path of the bore hole parallel to the axis of rotation 50. While the head is rotating there are no steering forces acting on the head and the head 10 and accompanying drill string 60 follow a straight path into the ground. Since the steering surface 43 turns within the bore hole diameter, there is no added drag to the drill string. Once of the depth of the bore is reached, and it is desirous to turn the drill head to a horizontal position, rotation of the string is stopped with the steering surface 43 facing downward. The particular orientation of the drill head in the ground is accomplished through the signals received from the sonde 28. With the steering surface 43 facing downward, the drilling head 10 is advanced without rotation. In the absence of a bore hole cut by rotating blade 20, the steering surface 43 applies a lateral force to the head 10 as it is advanced causing the head and string to turn in the direction of the steering surface 43. Once the head is sufficiently turned for horizontal travel, the drive motor 64 begins rotating the drill head and string while motor 68 again advances the drill head and string in a straight line. Whenever it is desirous to again turn the drill string, rotation of the head is ceased and the steering surface is properly positioned for the next turn. The volume of water provided through jets 16 and 17 is sufficient to assist in cutting and steering control while not so great as to create excess water at the drilling frame work site. The flutes 44 on steering surface 43 provide increased tracking of the head during steering so that other lateral forces applied to the head, such as small rocks, do not disturb the intended steering path of the head. The presence of two or more jets provides a degree of safety in case one of the jets may plug and thereby the fluid assisted cutting is not completely lost.

While the invention has been described with a certain degree of particularity, it is manifest that changes may be made in the details of construction of the cutting blade and the separate steering ramp without departing from the spirit and scope of this disclosure. It is understood that the invention is not limited to the embodiment set forth herein, but is to be limited only by the scope of the attached claims including the full range of equivalents to which each element is entitled.

What is claimed is:

1. A steerable tool for drilling holes in the ground comprising:

a flexible tubular drill string;

a drill head on the forward end of said drill string having a hydraulic cutting nozzle and a cutting blade means attached thereto;

drive means for intermittent rotating and lineal advancement of the drill head;

fluid supply means supplying pressurized fluid to the drill string and a nozzle which produces a fluid cutting jet;

the cutting blade means is positioned with the plane of the blade on the axis of rotation of the drill head which cuts a blade hole radius in the ground; and ramp means attached to the head behind the blade including a steering surface positioned at an acute angle to the axis of rotation of the drill string for deflecting the drill head and its drill string in a particular direction by linear advancement of the drill head without rotation.

2. A steerable tool as set forth in claim 1 wherein the cutting blade extends equally from both sides of the drill head while the steerable surface of the ramp means remains inside said blade hole radius during rotation of the head.

3. A steerable tool as set forth in claim 1 where the cutting blade includes rotating outer edges which cut a blade hole radius in the ground, the steerable surface of the ramp means having a rear portion of reduced width so that while rotating the head, the ramp means remains inside said blade hole radius and provides no cutting action.

4. A steerable tool as set forth in claim 1 wherein the steerable surface of the ramp means is positioned at an angle of approximately between 6° and 12° to the axis of rotation of the drill string, the surface area having a width less than the cutting blade and a rear portion of reduced width so that during rotation of the head, the ramp means remains inside said blade hole radius without contacting the wall of the hole.

5. A steerable tool as set forth in claim 1 wherein the steering surface has a series of longitudinal flutes to improve tracking of the head on its intended course.

6. A steerable tool as set forth in claim 1, wherein the cutting blade has a stepped hardened cutting surface extending equally from both sides of the drill head.

7. A steerable tool as set forth in claim 1 wherein the drive head and ramp means includes radially spaced longitudinal slots therethrough for radio wave transmission and tracking of the drill head from above the ground.

8. A steerable tool as set forth in claim 1 the drill head including a longitudinal sonde cavity with a laterally spaced access opening extending substantially the full length of the cavity and a removable cover plate positioned in said access opening.

9. A steerable tool as set forth in claim 1 the drill head including a longitudinal sonde cavity with a laterally spaced access opening extending substantially the full length of the cavity and a removable cover plate positioned in said access opening and a plurality of longitudinal slots in the head extending from the sonde cavity outward radially around the head.

* * * * *